US008811853B2

(12) United States Patent
Kusukawa et al.

(10) Patent No.: US 8,811,853 B2
(45) Date of Patent: Aug. 19, 2014

(54) CLEANING DEVICE FOR AN IMAGE FORMING APPARATUS INCLUDING SEALING MEMBER AND SEPARATION CLAW

(75) Inventors: Takashi Kusukawa, Osaka (JP); Yuichi Koshimura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 135 days.

(21) Appl. No.: 13/325,821

(22) Filed: Dec. 14, 2011

(65) Prior Publication Data

US 2012/0155914 A1 Jun. 21, 2012

(30) Foreign Application Priority Data

Dec. 15, 2010 (JP) ..... 2010-279760

(51) Int. Cl.
*G03G 15/08* (2006.01)

(52) U.S. Cl.
USPC ..... 399/102

(58) Field of Classification Search
USPC ..... 399/102
See application file for complete search history.

(56) References Cited

U.S. PATENT DOCUMENTS

| | | | | | |
|---|---|---|---|---|---|
| 4,060,320 | A * | 11/1977 | Doi et al. | ..... | 399/398 |
| 2002/0155368 | A1* | 10/2002 | Iwamoto et al. | ..... | 430/124 |
| 2007/0071487 | A1* | 3/2007 | Makiura et al. | ..... | 399/102 |
| 2011/0227273 | A1* | 9/2011 | Osaki | ..... | 271/10.09 |

FOREIGN PATENT DOCUMENTS

| | | | |
|---|---|---|---|
| JP | H09-44045 | | 2/1997 |
| JP | 10153932 | A * | 6/1998 |
| JP | 2004-198979 | | 7/2004 |
| JP | 2004198979 | A * | 7/2004 |

* cited by examiner

*Primary Examiner* — David Gray
*Assistant Examiner* — Tyler Hardman
(74) *Attorney, Agent, or Firm* — Pearl Cohen Zedek Latzer Baratz LLP

(57) ABSTRACT

A cleaning device of the present invention includes: a housing with an opening that is open toward a photoreceptor drum; a cleaning roller that is contained inside the housing and disposed in contact with the photoreceptor drum; a sealing member for preventing toner leakage, detachably fixed to the housing; a separation claw that separates paper from a surface of the photoreceptor drum; and a positioning member that is integrated with the separation claw, in which the sealing member is positioned and fixed on the housing by the positioning member.

8 Claims, 8 Drawing Sheets

CLEANING DEVICE FOR AN IMAGE FORMING APPARATUS INCLUDING SEALING MEMBER AND SEPARATION CLAW

This application is based on and claims the benefit of priority from Japanese Patent Application No. 2010-279760, filed on 15 Dec. 2010, the content of which is incorporated herein by reference.

BACKGROUND OF THE INVENTION

1. Field of the Invention

The present invention is related to a cleaning device used in an image forming apparatus such as a copy machine, a printer, and the like, and an image forming apparatus provided with the cleaning device.

2. Related Art

An image forming apparatus such as a copy machine, a printer, and the like is provided with an image forming unit that applies an image forming process to paper. In the image forming unit, an image carrier is disposed and an image (toner image) is formed on the paper. An electrostatic latent image is formed on a surface of a photoreceptor drum, which is the image carrier, and a toner image is formed in such a way that a toner adheres electrostatically to the electrostatic latent image. By feeding a sheet of paper to a place on the surface of the photoreceptor drum in which the toner image is formed and performing a transfer process, the toner image is transferred to the paper.

On the other hand, residual toner that has not been completely transferred and electrical discharge product generated during formation of the electrostatic latent image are adhered to the surface of the photoreceptor drum after transfer of the toner image. Such residual toner or electrical discharge product may prevent the next image formation. In other words, if toner or electrical discharge product remains on the surface of the photoreceptor drum, uneven application of toner and charged defects may occur during the next image formation and a satisfactory transferred image may not be obtained. For this, the image forming apparatus is provided with a cleaning device for removing adhesion matter (toner, electrical discharge product, and the like) on the surface of the photoreceptor drum.

FIG. 8 is a schematic cross-sectional view of a conventional cleaning device. As shown in FIG. 8, a cleaning device 1 includes a cleaning roller b. The cleaning roller b is disposed to be in contact with a photoreceptor drum c. By rotating the cleaning roller b in a state of contacting the photoreceptor drum c, the surface of the photoreceptor drum c is rubbed. The cleaning roller b has a function of physically and electrostatically removing adhesion matter (toner, electrical discharge product, and the like) on the surface of the photoreceptor drum c.

The adhesion matter on the surface of the photoreceptor drum c thus removed by the cleaning roller b is collected on the inside of the cleaning device a. Between the housing d and the photoreceptor drum c of the cleaning device a, a sealing member e is provided. Leakage of collected matter (not illustrated) to the outside of the housing d is thus prevented, and scattering of the toner to peripheral members of the cleaning device a (for example, a transfer device, a charging device and the like) is further prevented.

In the conventional art, the abovementioned sealing member is generally fixed by a screw to the housing. However, the screw may be loosened due to vibration generated by operation of the image forming apparatus. In other words, the vibration generated in association with operations such as a cleaning operation and image forming operation may be transmitted the screw, loosen the screw and unscrew the screw. Therefore, it has been difficult to completely prevent leakage of the toner collected on the inside of the cleaning device (housing) to the outside of the cleaning device. In addition, since the abovementioned fixing by a screw in the conventional art requires a step of fixing by the screw, there is a problem of an increased number of steps for assembling the cleaning device and reduced production efficiency.

SUMMARY OF THE INVENTION

The present invention relates to a cleaning device including: a housing with an opening that is open toward a photoreceptor drum; a cleaning roller that is contained inside the housing and disposed in contact with the photoreceptor drum; a sealing member for preventing toner leakage, detachably fixed to the housing; a separation claw that separates paper from a surface of the photoreceptor drum; and a positioning member that is integrated with the separation claw, in which the sealing member is positioned and fixed on the housing by the positioning member.

The present invention relates to image forming apparatus provided with a cleaning device of the above-mentioned composition.

DETAILED DESCRIPTION OF THE INVENTION

Figure 1:
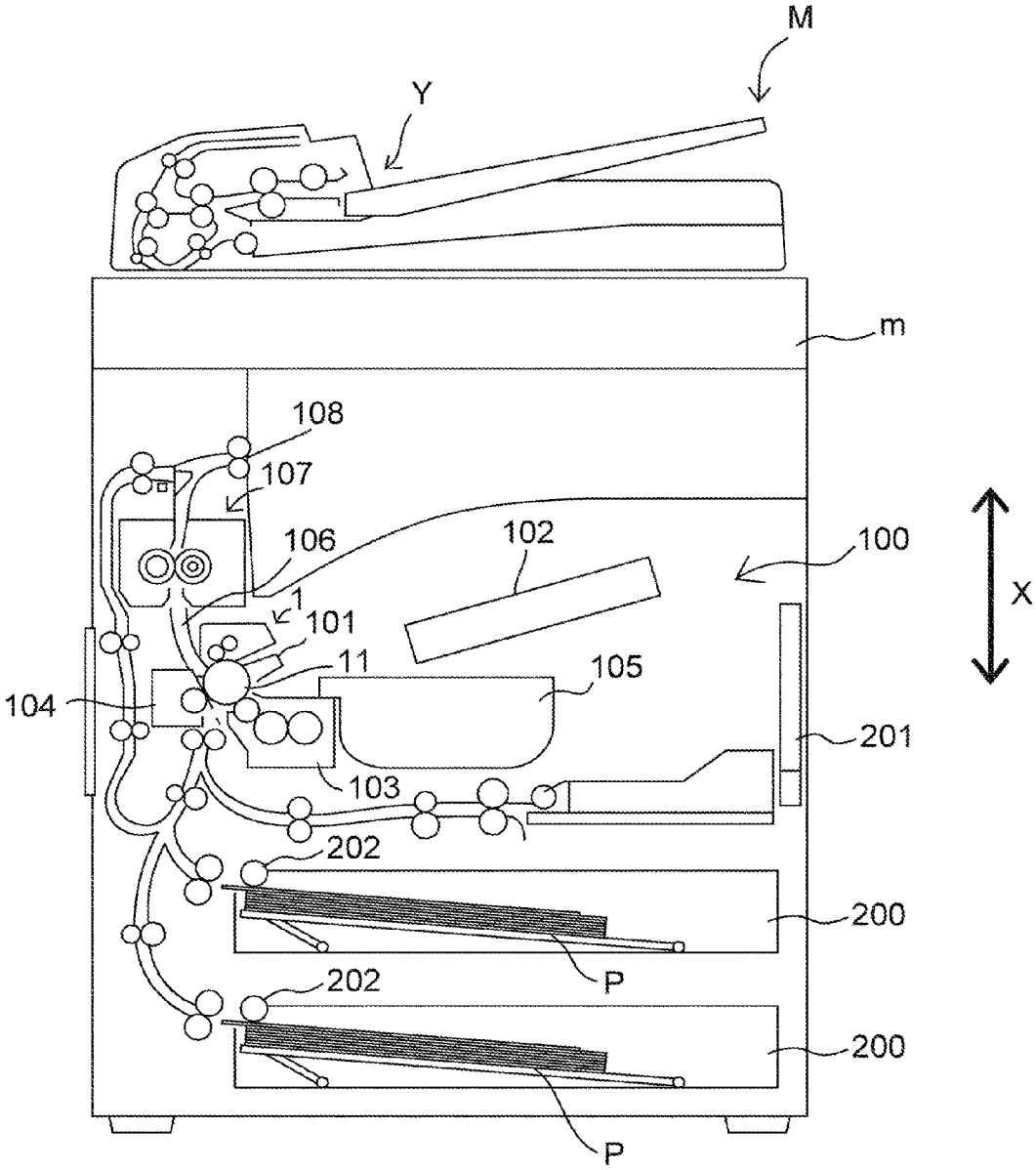
FIG. 1 is a schematic cross-sectional view of an image forming apparatus provided with a cleaning device according to the present invention.

A cleaning device and an image forming apparatus provided with the cleaning device are described hereinafter with reference to the drawings. FIG. 1 is a schematic cross-sectional view of an image forming apparatus provided with the cleaning device according to the present invention. The image forming apparatus shown in FIG. 1 is a black and white multifunction machine. The image forming apparatus according to the present invention can be a tandem-type color printer, a multifunction machine, a facsimile machine, or the like.

The image forming apparatus M includes, inside an apparatus main body m thereof, an image forming unit 100. The image forming unit 100 is provided with: a cleaning device 1; a photoreceptor drum 11; a charging device 101; an exposure device 102; a developing device 103; and a transfer device 104. A toner container 105 that supplies a toner to the developing device 103 is provided adjacently to the developing device 103. In addition, a scanner Y that read by scanning the image is placed in an upper portion of the apparatus main body m in a vertical direction X in FIG. 1.

The surface of the photoreceptor drum 11 is charged by the charging device 101. An electrostatic latent image is formed by the exposure device 102 on the surface of the photoreceptor drum 11 thus charged. The electrostatic latent image is formed into an image (toner image) by electrostatically depositing the toner supplied from the developing device 103. The toner image formed on the surface of the photoreceptor drum 11 is transferred to paper P by the transfer device 104. The paper P is fed either from a paper feeding cassette 200 to the image forming unit 100 via the paper feeding unit 202, or from a manual feeding tray 201 to the image forming unit 100. The toner image is transferred to the paper P by a nip between the photoreceptor drum 11 and the transfer device 104. The paper P onto which the toner image is transferred is fed to a fusing device 107 through a paper path 106. By performing a fusing process in the fusing device 107, the transferred image is fused onto the paper P. After the fusing process, the paper P is further fed and discharged to the outside of the apparatus main body m through a paper discharge unit 108.

Figure 2:
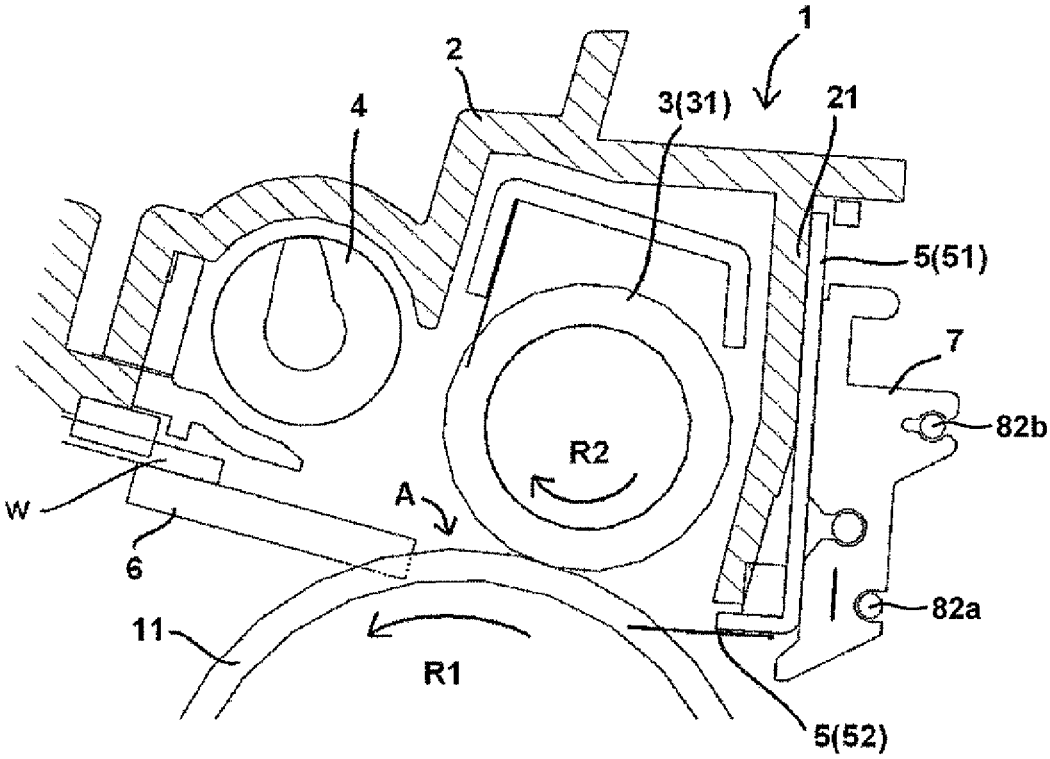
FIG. 2 is a schematic cross-sectional view of the cleaning device according to the present invention.

As shown in FIG. 1, the cleaning device 1 is provided inside the image forming unit 100 in the apparatus main body m. As illustrated, the cleaning device 1 is disposed to face the photoreceptor drum 11. FIG. 2 is a schematic cross-sectional view of the cleaning device 1 according to the present invention. It should be noted that the cleaning device 1 according to the present invention is not limited to the configuration of the example illustrated in the drawings. In other words, members contained inside the housing 2 are not limited to a cleaning roller 3 and a toner collection screw 4 as shown in FIG. 2, but can include other members. For example, a toner thickness control member can be provided in contact with the cleaning roller 3.

As described above, the cleaning device 1 is provided with the housing 2. The housing 2 is configured such that a part thereof is open. An opening portion A of the housing 2 is opened toward the photoreceptor drum. Inside the housing 2 of the cleaning device 1, the cleaning roller 3 supported on a shaft. A part of the surface of a roller main body 31 of the cleaning roller 3 is exposed through the opening portion A as shown in FIG. 2, along the whole length thereof in an axial direction. The cleaning roller 3 is disposed such that the part of the surface of the roller main body 31 exposed through the opening portion A is in contact with the photoreceptor drum 11 along the whole length thereof in the axial direction.

The cleaning roller 3 is rotated by a driving means (not illustrated) and rubs the surface of the photoreceptor drum 11 while being rotated. The photoreceptor drum 11 supported on a shaft and rotated by a driving means (not illustrated) that is different from that of the cleaning roller 3. Although there is no particular limitation with regard to rotational directions of the photoreceptor drum 11 and the cleaning roller 3, the rotational directions are preferably opposite directions as shown by arrows R1 and R2 in FIG. 2. As the photoreceptor drum 11 and the cleaning roller 3 rotate in the directions of R1 and R2 as shown, a deflection failure due to excessive load applied to both of the photoreceptor drum 11 and the cleaning roller 3 can be prevented, thereby allowing smooth cleaning operation.

As described above, the surface of the photoreceptor drum 11 is cleaned by being rubbed by the cleaning roller 3 (the roller main body 31). In other words, the cleaning roller 3 removes the adhesion matter on the surface of the photoreceptor drum 11 and conveys the adhesion matter thus removed to the inside of the housing 2. The adhesion matter (mainly toner, not illustrated) collected by the cleaning roller 3 is first collected into the housing 2 and then discharged to the outside of the cleaning device 1 by the toner collection screw 4. The adhesion matter discharged to the outside of the cleaning device 1 is collected into a toner collection container (not illustrated) provided inside the apparatus main body m.

The sealing member 5 is fixed onto a sealing member attachment surface 21 of the housing 2. In addition, a cleaning blade supporting member W is attached to an end of the housing 2 on the opposite side to the sealing member attachment surface 21 across the opening A. A cleaning blade 6 is fixed to the housing 2 via the cleaning blade supporting member W. The cleaning blade 6 is arranged so as to contact the photoreceptor drum 11 as shown in FIG. 2.

The sealing member 5 is composed of a plate-like member 51 and a film-like member 52. The sealing member 5 is fixed in such a way that the plate-like member 51 is attached to the sealing member attachment surface 21 of the housing 2. The plate-like member 51 has an L-shape with one end being bent, as shown in FIG. 2. The film-like member 52 is attached to an end portion of the plate-like member 51 on the opening A side. As shown in FIG. 2, the film-like member 52 is provided so as to be in contact the photoreceptor drum 11. In a configuration as shown in FIG. 2, the adhesion matter (mainly toner) thus collected can be prevented from leaking to the outside of the housing 2. A well-known material, specifically a polyethylene terephthalate (PET) film for example, can be used as the sealing member 5.

Figure 3:
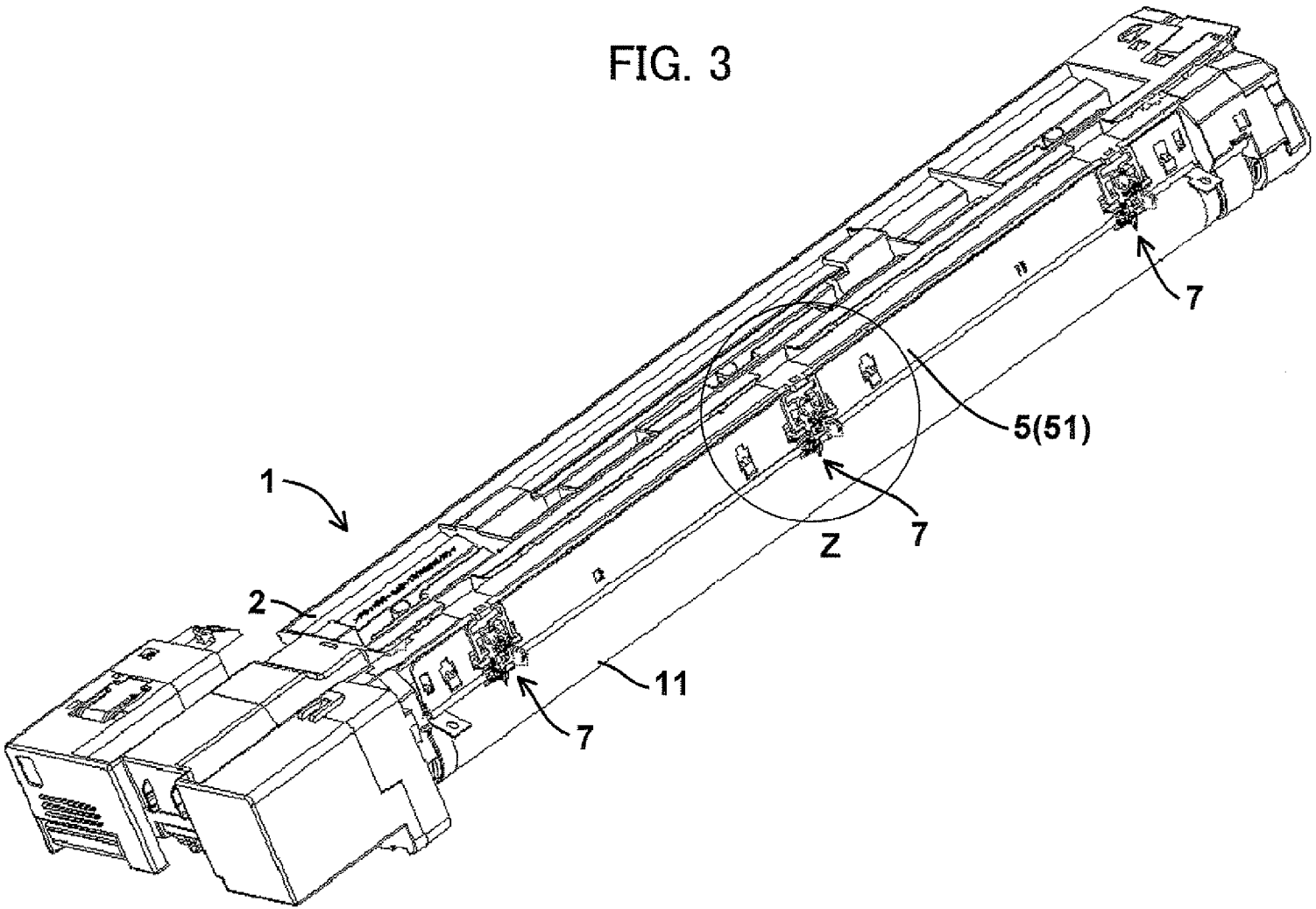
FIG. 3 is an overall view of the cleaning device of the present invention, illustrating a state in which the device is installed to face a photoreceptor drum.

FIG. 3 is an overall view of the cleaning device 1 of the present invention, illustrating a state in which the device is installed to face the photoreceptor drum 11. The cleaning device 1 and the photoreceptor drum 11 are assembled to a state shown in FIG. 3 and installed inside of the image forming unit 100 in the apparatus main body m.

As shown in FIG. 3, the sealing member 5 (the plate-like member 51) is fixed (positioned) to the housing 2 by a plurality of positioning members 7. In other words, as described above, the plate-like member 51 composing the sealing member 5 is fixed to the sealing member attachment surface 21 (outside of the housing 2). The sealing member 5 is fixed (positioned) at least at two positions. As shown in FIG. 3, the sealing member 5 is preferably fixed at three positions. By fixing the sealing member 5 at three positions, as shown in the drawing, the sealing member 5 can be fixed (positioned) most reliably and efficiently.

Figure 4:
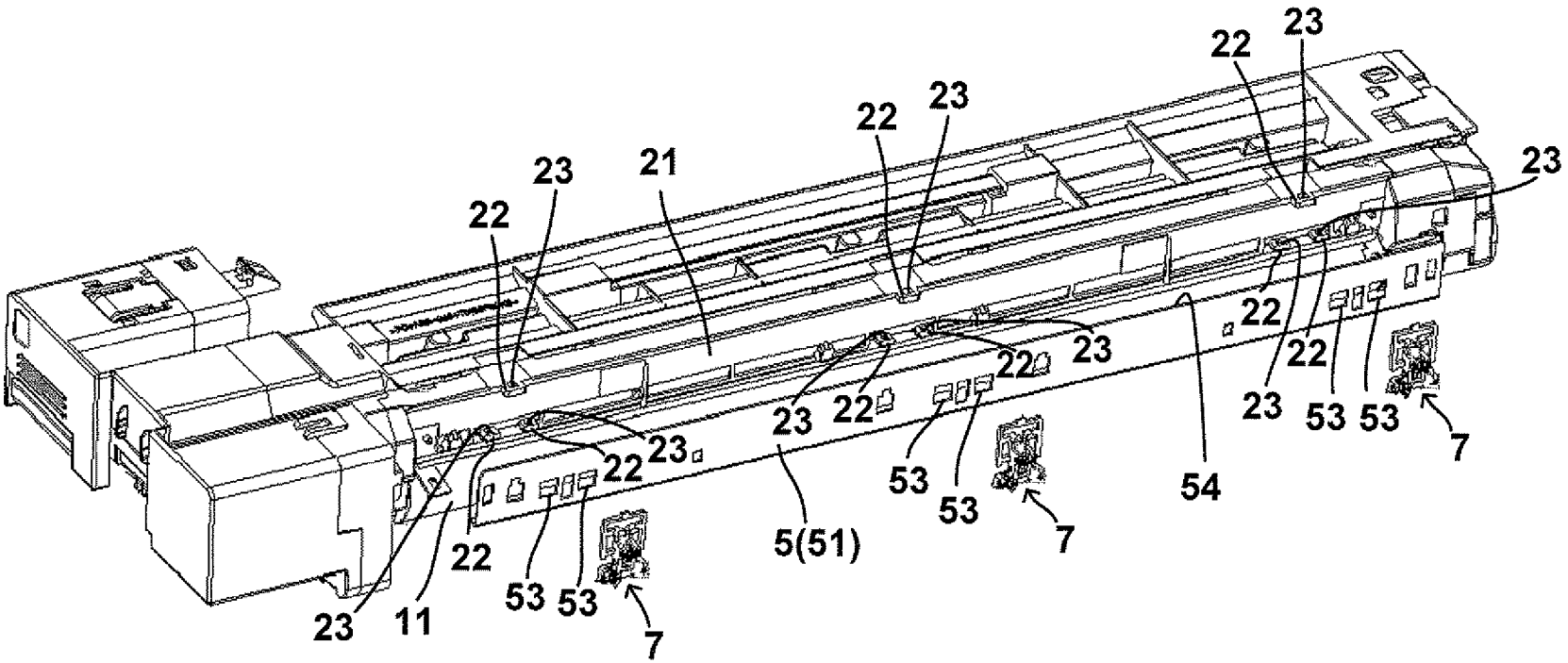
FIG. 4 is an overall view of the cleaning device of the present invention, illustrating a state in which a positioning member and a sealing member are removed.

FIG. 4 is an overall view of the cleaning device 1 of the present invention, illustrating a state in which the positioning member 7 and the sealing member 5 are removed. As described above, the sealing member 5 is configured to be detachable. As shown in FIGS. 3 and 4, the sealing member 5 (the plate-like member 51) is attached to the outside of the housing 2 (the sealing member attachment surface 21) by the positioning members 7.

Figure 5:
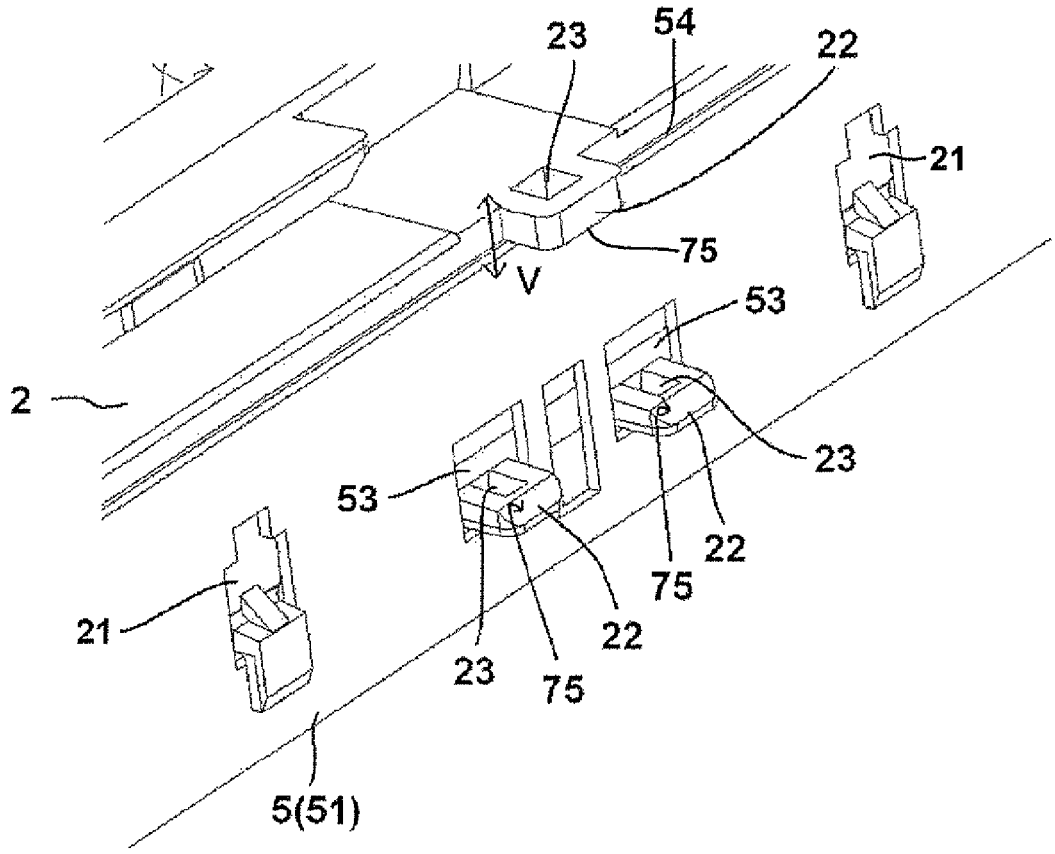
FIG. 5 is a diagram illustrating a state in which a penetrating projection is inserted into a penetrating hole.
Figure 6:
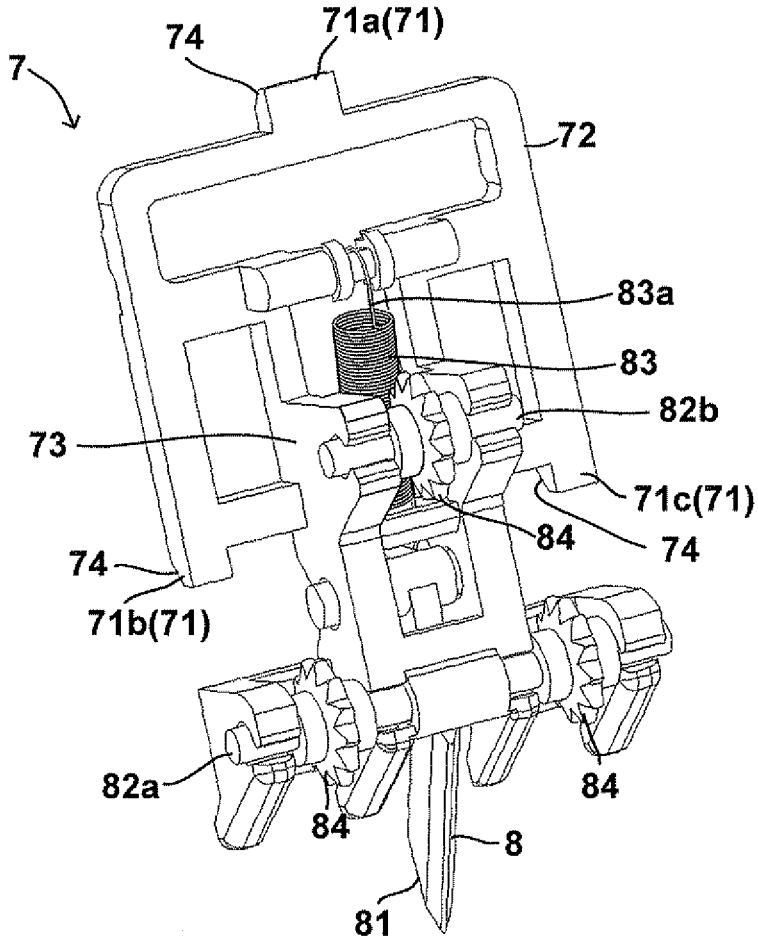
FIG. 6 is a front perspective view of the positioning member.

FIG. 5 is a diagram illustrating a state in which the penetrating projection 22 provided on the outside of the housing 2 (namely the sealing member attachment surface 21) is inserted into the penetrating hole 53 provided on the sealing member 5. FIG. 6 is a front perspective view of the positioning member 7. As shown in FIGS. 4 and 5, the penetrating projection 22 projecting toward the outside of the housing 2 is provided on the sealing member attachment surface 21. A tip of the penetrating projection 22 is tilted and forms a tilted surface 75. A positioning hole 23 is provided on the penetrating projection 22 provided on the sealing member attachment surface 21. As shown in FIG. 5, the positioning hole 23 is provided to penetrate the penetrating projection 22 in the thickness direction V.

Regarding the penetrating projection 22 on the sealing member attachment surface 21, a plurality of the penetrating projections 22 is preferably provided for a single positioning member 7. As a result, the positioning member 7 is reliably fixed by the penetrating projections 22 at a plurality of positions. Therefore, the sealing member 5 will not be displaced and can exhibit sealing properties, thereby preventing leakage of the adhesion matter (mainly toner) collected on the inside of the housing 2.

More specifically, as shown in FIGS. 4 and 5, a configuration is preferable in which the sealing member 5 is positioned at three positions in total by providing two penetrating projections 22 on a near side to the photoreceptor drum 11 and one penetrating projection 22 on a far side to the photoreceptor drum 11 on the sealing member attachment surface 21. The sealing member 5 can be fixed more securely by positioning at three positions. Therefore, the collected matter (toner) can be prevented from leaking to the outside of the housing 2. In addition, this can simplify configuration of the positioning member 7 (described later) and can fix the sealing member 5 securely.

In the vicinity of a longitudinal center line of the plate-like member 51 (the sealing member 5), the penetrating hole 53 is provided. As shown in FIG. 5, two penetrating projections 22 provided on the near side to the photoreceptor drum 11 on the sealing member attachment surface 21 are inserted into the penetrating hole 53 provided in the sealing member 5. On the other hand, one penetrating projection 22 provided on the far side to the photoreceptor drum 11 on the sealing member attachment surface 21 is in contact with an end portion 54 of the plate-like member 51 (sealing member 5).

As shown in FIG. 6, the positioning member 7 has a structure that integrates a separation claw 8 for separating paper adhering to the surface of the photoreceptor drum 11 and a conveyance guide roller 84. The positioning member 7 is provided with a supporting frame 72 having a fitting projection 71.

More specifically, the positioning member 7 exemplified in the drawings is provided with the supporting frame 72 having three fitting projections: a first fitting projection 71*a*; a second fitting projection 71*b*; and a third fitting projection 71*c*. The second fitting projection 71*b* and the third fitting projection 71*c* are arranged on the supporting frame 72 on a near side to the conveyance guide roller 84, as shown in FIG. 6. The first fitting projection 71*a* is arranged on the supporting frame 72, on an opposite side to the conveyance guide roller 84. Ends of the fitting projections 71*a*, 71*b*, 71*c* are preferably formed as tilted surfaces 74 that are tilted from a rear side to a front side of the supporting frame 72. This allows the fitting projections 71*a*, 71*b*, 71*c* to be easily fitted into the positioning holes 23 and to be not easily disengaged from the positioning holes 23 due to vibration and the like.

As shown in FIG. 6, The separation claw 8 is integrated with the supporting frame 72 having the fitting projections 71*a*, 71*b*, 71*c*, via a base member 73. A tilted tip portion 81 of the separation claw 8 is directed to the photoreceptor drum 11. In addition, the separation claw 8 is biased by a biasing member 83 (such as a spring) such that the tilted tip portion 81 is in pressure contact with the photoreceptor drum 11. In a case of using a spring as the biasing member 83, a first end 83*a* of the spring is hung on the supporting frame 72 and a second end (not illustrated) is connected to the separation claw 8, as shown in FIG. 6.

In addition, a supporting shaft 82*a* is inserted into the base member 73 so as to be orthogonal to the separation claw 8, as shown in FIG. 6. A pair of conveyance guide rollers 84 is connected to the supporting shaft 82*a* so as to sandwich the separation claw 8 from both sides. In addition, as shown in FIG. 6, a supporting shaft 82*b* that is parallel to the supporting shaft 82*a* is inserted into the base member 73 in the vicinity of the supporting frame 72. A conveyance guide roller 84 is connected to the supporting shaft 82*b*. The conveyance guide roller 84 has a function of guiding conveyance of the paper to the next step. By arranging three conveyance guide rollers 84 as shown in FIG. 6, the paper can be reliably fed to the next step.

The conveyance guide rollers 84 are preferably pulleys with a corrugated surface as shown in FIG. 6. This can reduce area of contact between the conveyance guide rollers 84 and the paper. At the time of passing through the photoreceptor drum 11, a fusing process has not been applied to the toner image that has been transferred to the paper. Therefore, if the area of contact between the conveyance guide rollers 84 and the paper is great, there is a risk of unfused toner adhering to the conveyance guide rollers 84. In other words, there is a risk that a good quality image will not be obtained.

Figure 7:
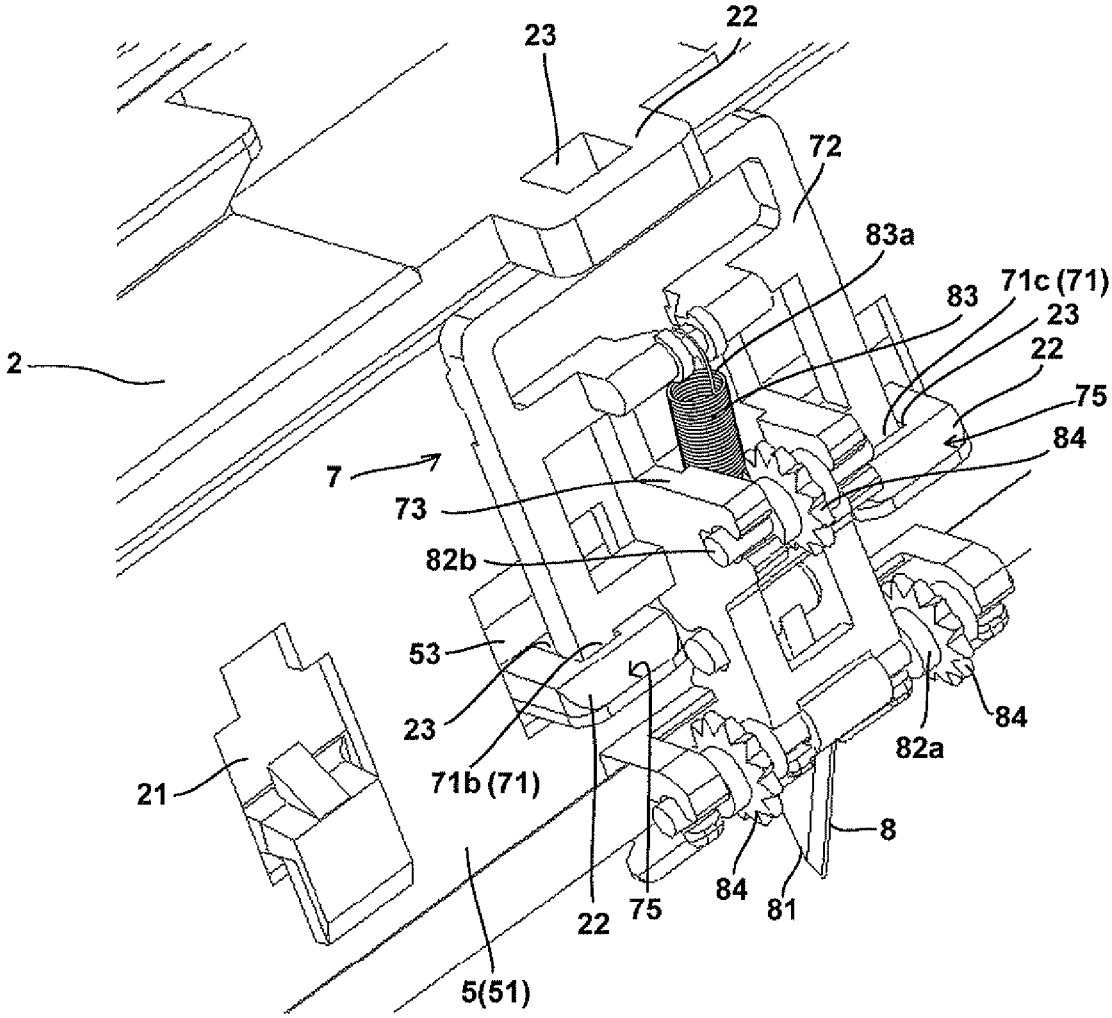
FIG. 7 is an enlarged view of a portion Z of FIG. 3.
Figure 8:
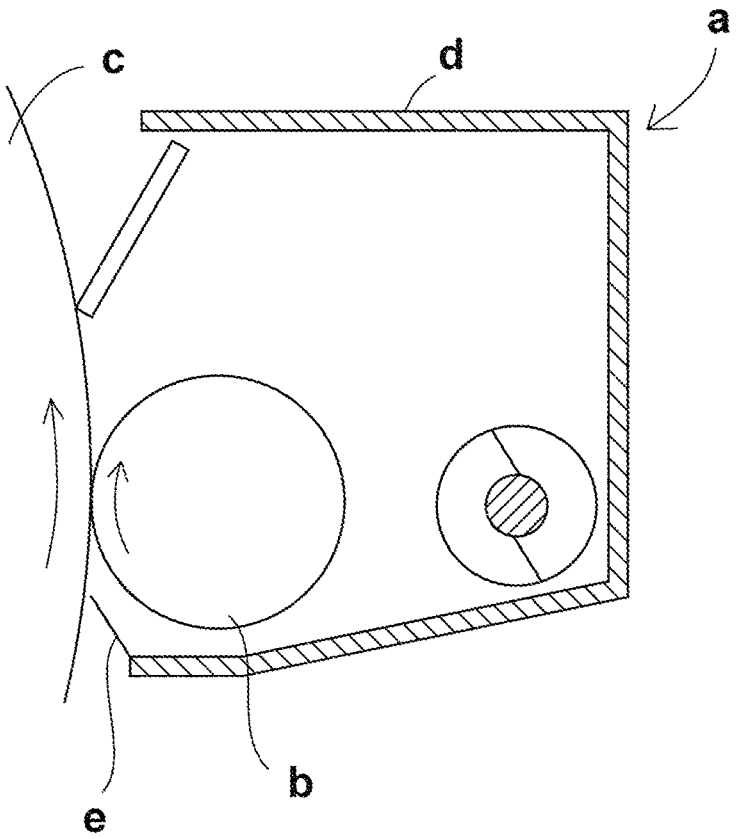
FIG. 8 is a schematic cross-sectional view of a conventional cleaning device.

FIG. 7 is an enlarged view of a portion Z of FIG. 3, illustrating a state in which the sealing member 5 is fixed to the housing 2 (the sealing member attachment surface 21) by the positioning member 7. In other words, FIG. 7 is a diagram illustrating a state in which two penetrating projections 22 provided on the housing 2 (the sealing member attachment surface 21) are inserted into two penetrating holes 53 provided on the sealing member 5, a state shown in FIG. 5. As shown in FIG. 7, the fitting projections 71*a*, 71*b*, 71*c* provided on the positioning member 7 are fitted respectively into the positioning holes 23, one of which is provided in each of the three penetrating projections 22. In this state, the sealing member 5 is positioned and fixed on the housing 2 by the positioning member 7.

Here, if tips of the fitting projections 71*a*, 71*b*, 71*c* and the penetrating projection 22 are the tilted surfaces 74 and 75, the fitting projections 71*a*, 71*b*, 71*c* can be easily fitted into the positioning holes 23 by pressing the positioning member 7 toward the sealing member attaching surface 21 (the plate-like member 51) of the housing 2. In other words, as the tilted surface 74 of the fitting projections 71*a*, 71*b*, 71*c* can slide along the tilted surface 75 of the penetrating projection 22, the fitting projections 71*a*, 71*b*, 71*c* can be easily fitted into the positioning holes 23. Therefore, during fitting, excessive load is not applied to the fitting projections 71*a*, 71*b*, 71*c*, or the penetrating projection 22. This can prevent breakage of the fitting projections 71*a*, 71*b*, 71*c* and the penetrating projection 22 during assemblage.

The housing 2 and the sealing member 5 can be fixed reliably with a simple operation of fitting the positioning member 7, without requiring fixing by a screw. In addition, as shown in FIG. 7, by fixing the housing 2 and the sealing member 5 at three positions, there is little risk of the sealing member 5 becoming dislodged from the housing 2 due to vibration generated during operation (for example, cleaning operation, image formation and the like). As a result, leakage of adhesion matter (mainly toner) of the surface of the photoreceptor drum 11, which has been collected into the housing 2, can be prevented.

According to the present invention, the sealing member can be reliably fixed to the housing. The present invention does not require fixing by a screw as in the conventional art, thereby reducing the number of steps for assembly and increasing production efficiency.

According to the present invention, the cleaning device can be easily assembled while maintaining sufficient assembly accuracy between the housing and the sealing member.

According to the present invention, a tip of the fitting projection is formed as a tilted surface, so that excessive load is not applied during attachment of the positioning member. In other words, the fitting projection can be smoothly slid to fit into the positioning hole, so that there is little risk of breakage of the penetrating projection and the like provided on the positioning member and the housing.

What is claimed is:

1. A cleaning device comprising:

a housing with an opening that is open toward a photoreceptor drum;

a cleaning roller that is contained inside the housing and disposed in contact with the photoreceptor drum;

a sealing member configured to prevent toner leakage, detachably fixed to the housing;

a separation claw configured to separate paper from a surface of the photoreceptor drum;

a positioning member that is integrated with the separation claw, and a conveyance guide roller configured to guide paper to be conveyed, wherein the positioning member is attached to the housing such that the sealing member is positioned and fixed on the housing by the positioning member, wherein the positioning member is integrated with the conveyance guide roller, wherein the housing includes a penetrating projection;

the penetrating projection includes a positioning hole;

the sealing member includes a penetrating hole into which the penetrating projection can be inserted;

the positioning member includes a fitting projection that can be fitted into the positioning hole; and the sealing member is positioned and fixed to the housing by the positioning member in a state in which the penetrating projection is inserted into the penetrating hole and in which the fitting projection is fitted into the positioning hole formed on the penetrating projection.

2. The cleaning device according to claim 1, wherein a tip of the fitting projection is formed as a tilted surface.

3. An image forming apparatus comprising the cleaning device according to claim 1.

4. An image forming apparatus comprising the cleaning device according to claim 2.

5. A cleaning device comprising:

a housing with an opening that is open toward a photoreceptor drum;

a cleaning roller that is contained inside the housing and disposed in contact with the photoreceptor drum;

a sealing member configured to prevent toner leakage, detachably fixed to the housing;

a separation claw configured to separate paper from a surface of the photoreceptor drum; and a positioning member that is integrated with the separation claw, wherein the sealing member is positioned and fixed on the housing by the positioning member, and the housing includes a penetrating projection, the penetrating projection includes a positioning hole, the sealing member includes a penetrating hole into which the penetrating projection can be inserted, the positioning member includes a fitting projection that can be fitted into the positioning hole, and the sealing member is positioned and fixed to the housing by the positioning member in a state in which the penetrating projection is inserted into the penetrating hole and in which the fitting projection is fitted into the positioning hole formed on the penetrating projection.

6. The cleaning device according to claim 5 further comprising a conveyance guide roller configured to guide paper to be conveyed, wherein the positioning member is integrated with the conveyance guide roller.

7. The cleaning device according to claim 5, wherein a tip of the fitting projection is formed as a tilted surface.

8. An image forming apparatus comprising the cleaning device according to claim 5.

* * * * *